US010501960B2

(12) United States Patent
Knudsen

(10) Patent No.: US 10,501,960 B2
(45) Date of Patent: Dec. 10, 2019

(54) RAIL INSERT

(71) Applicant: N. Eric Knudsen, Maple Valley, WA (US)

(72) Inventor: N. Eric Knudsen, Maple Valley, WA (US)

( * ) Notice: Subject to any disclaimer, the term of this patent is extended or adjusted under 35 U.S.C. 154(b) by 398 days.

(21) Appl. No.: 15/173,271

(22) Filed: Jun. 3, 2016

(65) Prior Publication Data

US 2017/0350157 A1 Dec. 7, 2017

(51) Int. Cl.

| | |
|---|---|
| ***E04H 17/14*** | (2006.01) |
| ***E04H 17/20*** | (2006.01) |
| ***A01K 3/00*** | (2006.01) |

(52) U.S. Cl.

CPC ..... *E04H 17/1421* (2013.01); *A01K 3/00* (2013.01); *E04H 17/20* (2013.01); *E04H 2017/1473* (2013.01); *E04H 2017/1491* (2013.01)

(58) Field of Classification Search

CPC ..... E04H 17/20; E04H 17/1421; E04H 2017/1473; E04H 2017/1491; E04H 17/1434; E04H 17/1443; E04H 2017/1447; E04H 2017/1452

USPC ..... 256/59, 60, 65.01, 65.02, 65.03, 65.07, 256/65.08, 65.12, 68, 69, 70; 403/231, 403/294, DIG. 12; 52/285.2

See application file for complete search history.

(56) References Cited

U.S. PATENT DOCUMENTS

| | | | | |
|---|---|---|---|---|
| 3,055,640 | A * | 9/1962 | Thom | E04F 11/181 256/65.03 |
| 3,456,969 | A * | 7/1969 | Wittenmayer | F16B 12/2009 403/231 |
| 3,695,655 | A * | 10/1972 | Wippermann | F16B 12/2054 403/260 |
| 4,060,949 | A * | 12/1977 | Busse | F16B 12/24 403/231 |
| 4,353,663 | A * | 10/1982 | Glickman | F16B 12/20 403/230 |
| 4,639,161 | A * | 1/1987 | Mazaki | F16B 12/20 403/231 |
| 5,215,290 | A * | 6/1993 | Khalessi | E04H 17/1421 256/19 |
| 5,368,426 | A * | 11/1994 | Reeves | F16B 12/46 403/205 |
| 5,403,109 | A * | 4/1995 | Johnson | F16B 12/2036 403/231 |
| 5,544,866 | A * | 8/1996 | Dye | E04F 11/1836 256/59 |
| 5,938,184 | A * | 8/1999 | DeSouza | E04H 17/1421 256/19 |
| 6,305,671 | B1 * | 10/2001 | Valentine | E04H 17/1443 256/65.13 |
| 6,478,518 | B1 * | 11/2002 | Hwang | F16B 12/14 411/104 |

(Continued)

*Primary Examiner* — Matthieu F Setliff

(74) *Attorney, Agent, or Firm* — Seed Intellectual Property Law Group LLP

(57) ABSTRACT

A system of fence components includes fence posts, fence rails having cavities formed in their ends, and fence rail inserts sized to be positioned within the fence rail cavities. The fence rail inserts and the fence rail cavities include corresponding mating features to allow the fence rail inserts to be positioned and locked within the fence rail cavities. The fence rail inserts also include fastener guides that allow a fastener to pass through to couple the fence rail inserts to the fence posts.

8 Claims, 13 Drawing Sheets

(56) References Cited

U.S. PATENT DOCUMENTS

| | | | | |
|---|---|---|---|---|
| 6,494,438 | B1 * | 12/2002 | Noirot | E04F 11/1812 256/59 |
| 6,698,726 | B2 * | 3/2004 | Platt | E04F 11/1834 16/224 |
| 6,908,252 | B1 * | 6/2005 | Rubano | F16B 12/2027 403/231 |
| 7,086,642 | B1 * | 8/2006 | O'Brien | E04H 17/1434 256/22 |
| 7,090,202 | B1 * | 8/2006 | O'Brien | E04H 17/1434 256/22 |
| 7,475,870 | B2 * | 1/2009 | Platt | E04F 11/1834 256/67 |
| 8,162,559 | B2 * | 4/2012 | Krige | A47B 47/0025 108/193 |
| 9,080,586 | B2 * | 7/2015 | Liu | F16B 12/14 |
| 2009/0148231 | A1 * | 6/2009 | Chang | F16B 12/10 403/346 |
| 2011/0073824 | A1 * | 3/2011 | Lappin | E04F 11/1817 256/65.08 |
| 2013/0277634 | A1 * | 10/2013 | Munyon | E04H 17/1421 256/67 |
| 2013/0328004 | A1 * | 12/2013 | Truckner | E04F 11/1834 256/65.01 |
| 2015/0240516 | A1 * | 8/2015 | Bertato | E04H 17/1421 256/65.03 |

* cited by examiner

RAIL INSERT

BACKGROUND

Technical Field

The disclosed embodiments relate in general to fence systems or other systems including rails and, in particular, to fence systems or other systems including rails that can be assembled using rail inserts.

Description of the Related Art

Fences are ubiquitous in modern society, used in a vast range of applications, to mark and accent boundaries, provide security, and control movement of people and animals. Thousands of miles of new and replacement fences are installed every year in the U.S., and utilize vast amounts of construction-related natural resources.

FIG. 1 shows a landscape with a fence 100 extending along portions thereof. The fence 100 shown in FIG. 1 comprises two major segments, or runs, 102. A run is a section or portion of a fence that extends between natural dividing points such as corners, gates, buildings, etc. Except where a fence is attached to a building, each run 102 generally has a main post 104*a* at each end and line posts 104 spaced between the main posts. Each pair of adjacent posts 104 has a fence panel 106 coupled between them. Each panel 106 comprises horizontal elements, or rails, 108, and vertical elements, or fence boards, 110. Although each of the fence panels 106 are shown as straight sections with horizontal rails 108, it is appreciated that rails 108 may be installed at oblique angles relative to the posts 104 to adapt, for example, to various land topographies or obstacles.

In view of the expense, labor, and waste associated with installing a fence that is custom-built on site, another method of building and installing fences has been introduced. Pre-manufactured fence panels are becoming more available, and increasingly can be found in a wide variety of materials, including wood, vinyl, composite, aluminum, steel, concrete, etc., and in a wide variety of designs.

One common failure mode of typical fence systems, whether custom-built on site or built using pre-manufactured fence panels, is the failure of the connection of the fence rails, such as rails 108 in FIG. 1, to the fence posts, such as posts 104 in FIG. 1. It is common to toenail the ends of the rails (often common 2×4 lumber) to the posts (often common 4×4 lumber), which can cause problems because the fence rails 108 can have knots at their ends where the nails pass through the rails at a steep angle, and because the rails 108 can move or crack under the point stress loads of the nails. As a result, the nails often pull loose from the posts, leading to failure of the fence. Clips or mounting brackets can be used to alleviate some of the problems associated with toenailed rails, however, the use of clips or brackets can be cumbersome and unsightly.

BRIEF SUMMARY

A structure may be summarized as comprising: a vertical fence member having a side surface; a rail extending outwardly from the side surface of the vertical fence member, the rail including an insert cavity at an end of the rail adjacent to the vertical fence member; a rail insert positioned within the insert cavity, the rail insert including a fastener guide; and a fastener extending through the fastener guide of the rail insert and into the side surface of the vertical fence member.

The rail may include an end face that is flush with the side surface of the vertical fence member. The rail may extend outwardly from the side surface of the vertical fence member at an oblique angle. The rail may extend outwardly from the side surface of the vertical fence member at an oblique angle relative to a vertical reference plane perpendicular to the side surface of the vertical fence member. The rail may extend outwardly from the side surface of the vertical fence member at an oblique angle relative to a horizontal reference plane. The cavity may include a blind hole formed in a first major side surface of the rail and a groove formed around a periphery of a bottom end of the blind hole, and the rail insert may include a ridge engaged with the groove to prevent movement of the rail insert toward the first major side surface of the rail. The insert cavity may be formed in the end of the rail such that the rail insert is slidably engageable with the rail in a direction aligned with a longitudinal length of the rail.

A rail assembly may be summarized as comprising: an elongated rail having a respective insert cavity formed in each of opposing ends thereof; and a respective rail insert insertably received in each insert cavity, each rail insert comprising a fastener guide to receive a fastener through the rail insert to secure the respective end of the rail to a vertical fence member.

Each of the insert cavities may include a peripheral groove and each respective rail insert may include a peripheral ridge engaged with the peripheral groove. Each rail insert may be accommodated within the confines of an outer profile of the elongated rail.

A method may be summarized as comprising: positioning an end of a rail adjacent to a side of a vertical fence member, the end of the rail having a rail insert accommodated in an insert cavity thereof, and the rail insert having a fastener guide; and extending a fastener through the fastener guide of the rail insert into the side of the vertical fence member to secure the end of the rail to the vertical fence member.

The rail may be a component of a pre-manufactured fence panel. The rail may be a component of a fence panel that is assembled on-site. The method may further comprise forming the insert cavity in the end of the rail based at least in part on information pertaining to an installation site. The method may further comprise inserting the rail insert into the insert cavity of the rail wherein inserting includes at least one of press-fitting and loosely fitting the rail insert within the insert cavity of the rail. Positioning the end of the rail adjacent to the side of the vertical fence member may comprise abutting an end face of the rail flush against the side of the vertical fence member.

The method may further comprise: determining a desired orientation of an end face of the rail based on information pertaining to an installation site; and cutting the rail such that the end face has the desired orientation. The method may further comprise: positioning an end of a second rail adjacent to the side of the vertical fence member, the end of the second rail having a rail insert accommodated in an insert cavity thereof, and the rail insert having a fastener guide; and extending a fastener through the fastener guide of the rail insert accommodated in the insert cavity of the second rail into the side of the vertical fence member to secure the end of the second rail to the vertical fence member.

The rail may include another insert cavity at an opposing end of the rail in which a second rail insert is accommodated, and the method may further comprise: supporting the opposing end of the rail adjacent another vertical fence member, and extending a fastener through a fastener guide in the second rail insert into the side of the other vertical fence member to secure the opposing end of the rail to the other vertical fence member. The method may further comprise: removing material from the rail to form the insert cavity at the end of the rail; and inserting the rail insert into the insert cavity.

A rail fastening system may be summarized as comprising: a plurality of rail inserts, each rail insert including a bottom end having a peripheral ridge, a top end opposite the bottom end, a front end extending between the bottom end and the top end, and at least one fastener guide extending from the front end to the top end at an oblique angle to the top end, wherein the front end extends at a different angle relative to the top end for each of at least some of the rail inserts.

The front end of at least one of the rail inserts may be perpendicular to the top end thereof. The front end of at least one of the rail inserts may be oblique to the top end thereof. A first fastener guide of a first one of the rail inserts may extend at a first oblique angle with respect to the top end of the first one of the rail inserts, a second fastener guide of a second one of the rail inserts may extend at a second oblique angle with respect to a top end of the second one of the rail inserts, and the first oblique angle may not be the same as the second oblique angle.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with the technology have not been shown or described in detail to avoid unnecessarily obscuring descriptions of the embodiments.

Unless the context requires otherwise, throughout the specification and claims that follow, the word "comprising" is synonymous with "including," and is inclusive or open-ended (i.e., does not exclude additional, unrecited elements or method acts).

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the context clearly dictates otherwise. It should also be noted that the term "or" is generally employed in its broadest sense, that is, as meaning "and/or" unless the context clearly dictates otherwise.

Figure 1:
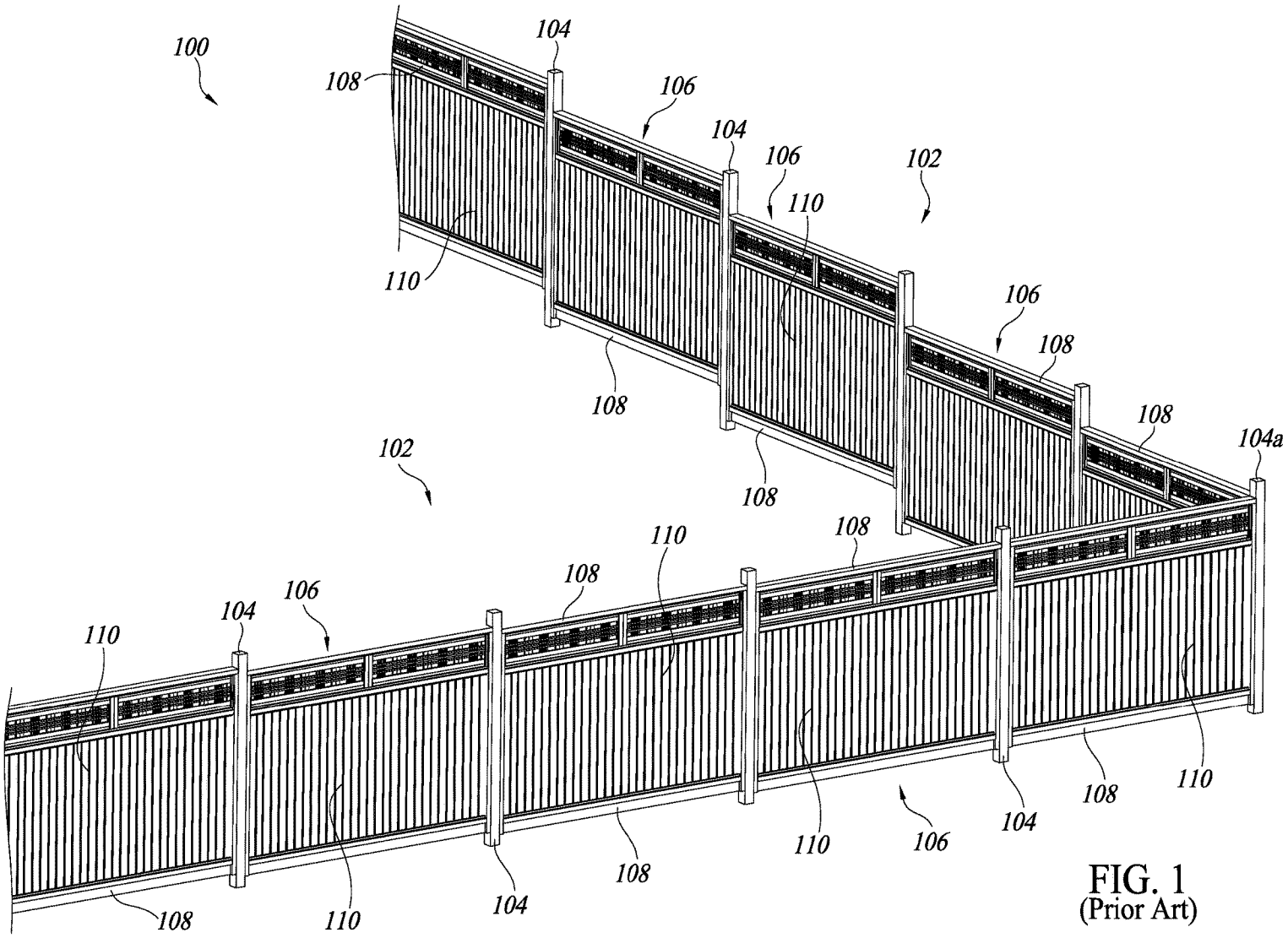
FIG. 1 (Prior Art)
FIG. 1 shows a landscape with a fence.
Figure 2:
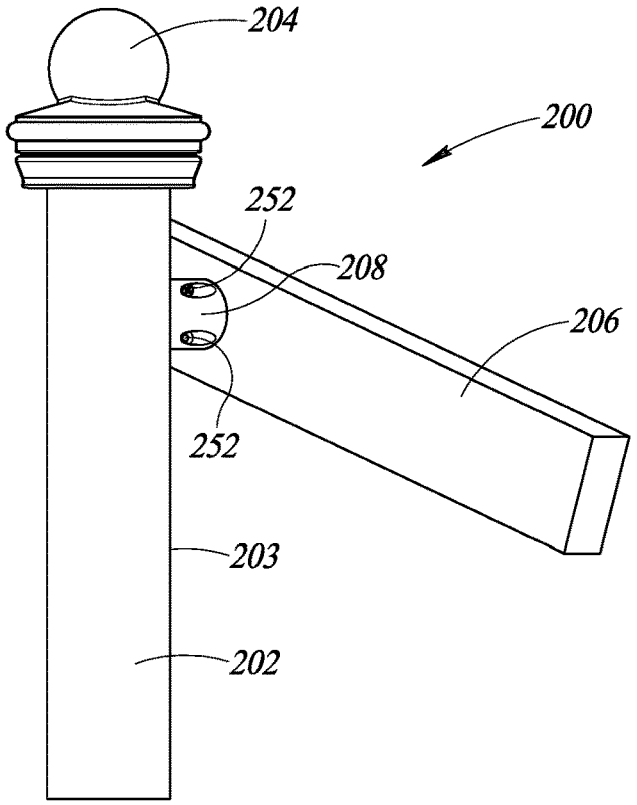
FIG. 2 shows a front view of a fence rail insert being used to couple a fence rail to a fence post.
Figure 3:
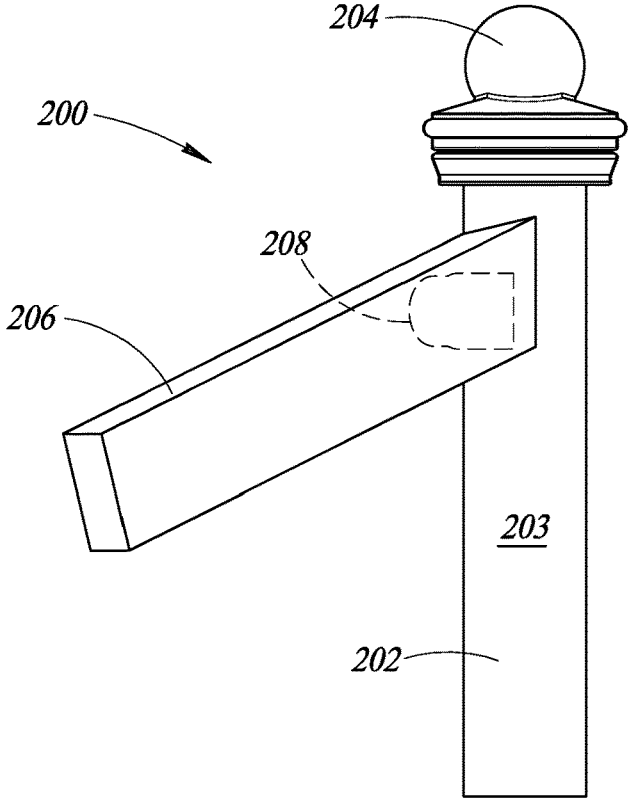
FIG. 3 shows a right side view of the fence rail insert of FIG. 2 being used to couple the fence rail of FIG. 2 to the fence post of FIG. 2.

FIG. 2 illustrates a front view of an assembly 200 of components of a fence coupled to one another, including a fence post 202 similar to the fence posts 104 illustrated in FIG. 1, a fence post cap 204, a fence rail 206 similar to the fence rails 108 illustrated in FIG. 1, and a fence rail insert 208 (which may also be referred to as a fence rail bracket). FIG. 3 illustrates a right-side view of the assembly 200. While the assembly 200 illustrates components of a fence, the same or similar components can be used to assemble other, similar structures, such as handrails, etc. The fence post 202 comprises a standard wooden 4×4 piece of lumber, the fence rail 206 comprises a standard wooden 2×4 piece of lumber, and the fence rail insert 208 comprises a plastic material, but in alternative embodiments, the fence post 202, the fence rail 206, and the fence rail insert 208 can have any suitable dimensions and can comprise any suitable materials. Further, the fence rail 206 can be a component of a custom-built fence or fence panel, or can be a component of a pre-manufactured fence panel, where other components of the pre-manufactured fence panel are not shown for simplicity of illustration.

As shown in FIGS. 2 and 3, the fence rail 206 is coupled to the fence post 202, which is vertical, so that the fence rail 206 is oriented downwardly relative to horizontal as it extends away from the fence post 202, and so that the fence rail 206 extends both forwards and to the right as it extends away from the fence post 202. As also shown in FIGS. 2 and 3, an end face 216 (FIGS. 4 and 5) of the fence rail 206 is flush with a side surface 203 of the fence post 202 when the fence rail 206 is coupled to the fence post 202. As described herein, the fence rail insert 208 can be used to couple fence rails to fence posts at a wide variety of different angles in all three spatial dimensions, while allowing end faces of the fence rails to sit flush against side surfaces of the fence posts, in the manner illustrated in FIGS. 2 and 3. Connections of fence rails to fence posts using the fence rail insert 208 can also be stronger and more durable than other types of connections, such as toenail joints. In addition, the fence rail inserts 208 may be accommodated within the confines of the outer profile of the fence rails 206 such that the fence rail inserts 208 may be completely hidden from view upon securing fence boards (e.g., fence boards 110 of FIG. 1) to the rails and such that the fence rail inserts 208 do not interfere with attaching said fence boards to the rails.

Figure 4:
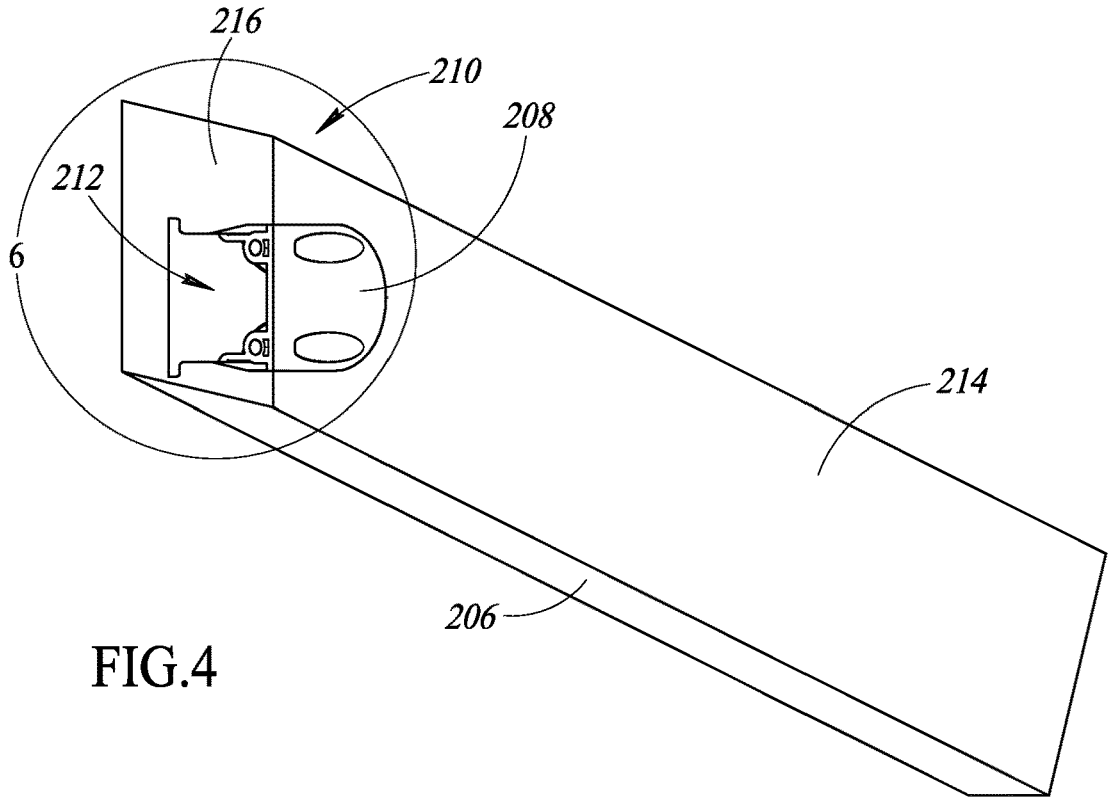
FIG. 4 shows the fence rail insert and fence rail of FIG. 2 without the fence post of FIG. 2.
Figure 5:
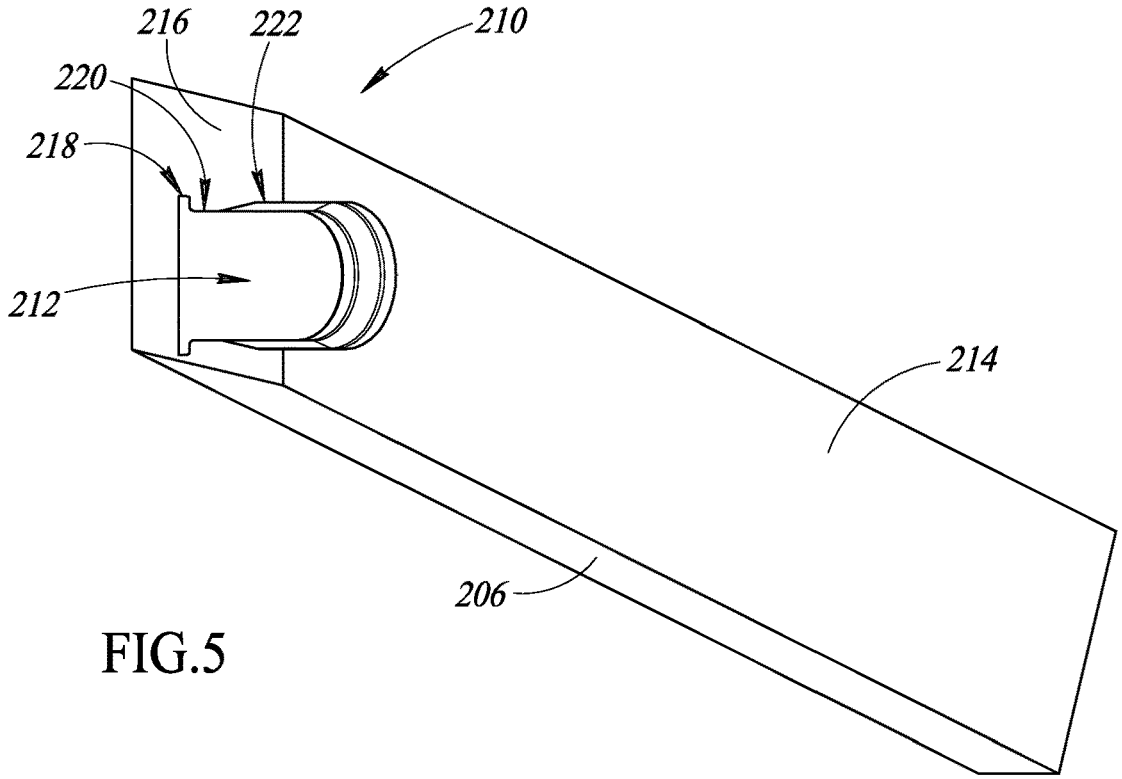
FIG. 5 shows the fence rail of FIG. 2 without the fence rail insert or the fence post of FIG. 2.
Figure 6:
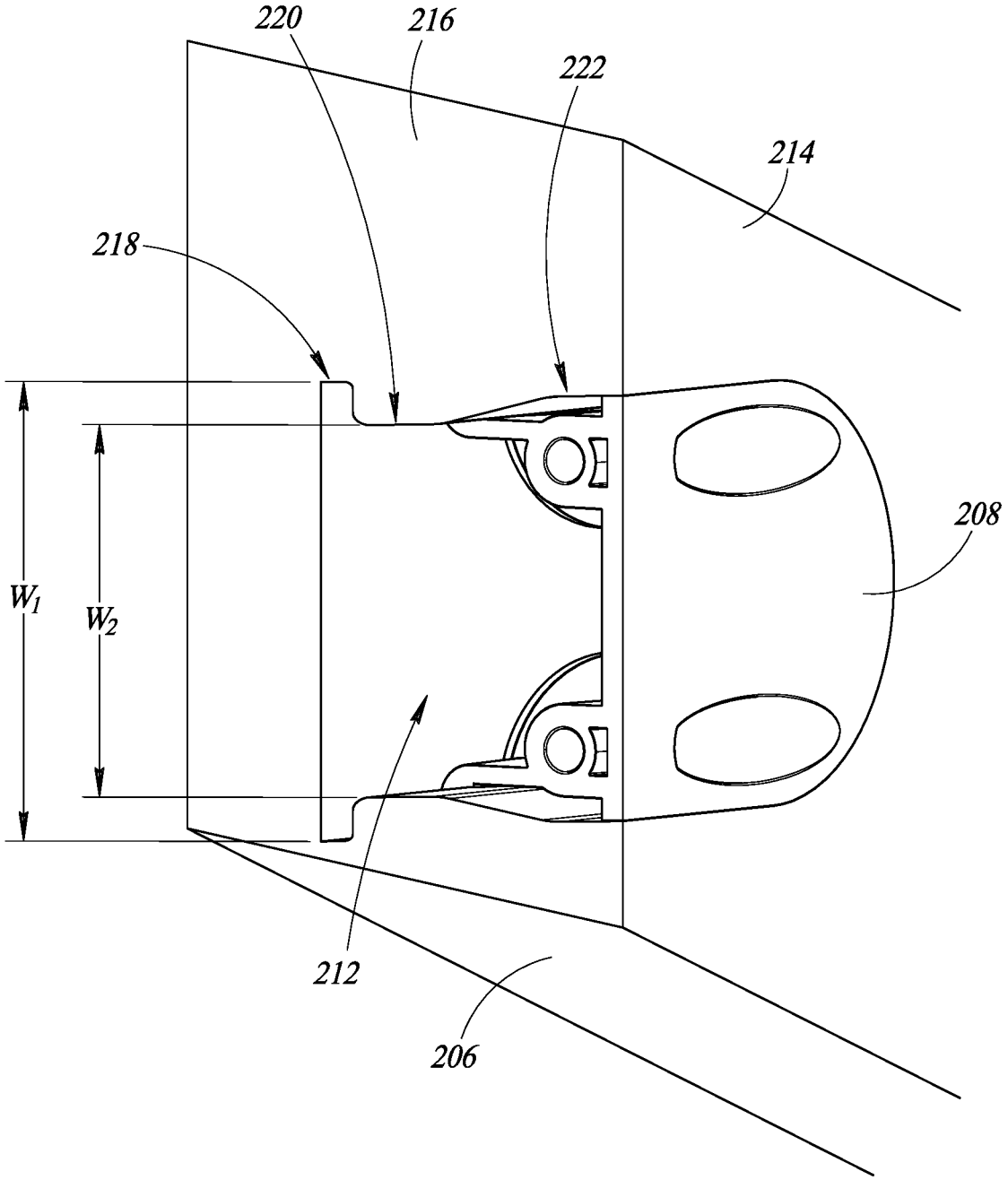
FIG. 6 shows an enlarged detail view of the fence rail insert and the fence rail taken from FIG. 4.

FIG. 4 illustrates the fence rail 206 and the fence rail insert 208 without the rest of the components of the assembly 200 and from another angle, to more clearly illustrate the fence rail 206 and the fence rail insert 208. As shown in FIG. 4, an end portion 210 of the fence rail 206 has a pocket or cavity 212 formed therein. The cavity 212 comprises a blind hole formed in a first major side surface 214 of the fence rail 206 partially through a width of the end portion 210 of the fence rail 206 and extends to the end face 216 of the fence rail 206. The cavity 212 can be formed using a variety of suitable techniques, including the use of a CNC (computer numerical control) wood router, or other material removal techniques. FIG. 5 illustrates the fence rail 206 without the rest of the components of the assembly 200 from the same angle as in FIG. 4, to more clearly illustrate the fence rail 206. FIG. 6 illustrates an enlarged portion of FIG. 4 to more clearly illustrate the fence rail 206 and the fence rail insert 208.

As shown in FIGS. 4 through 6, the fence rail insert 208 is positioned and seated within the cavity 212. The fence rail insert 208 can be secured to the fence rail 206 within the cavity 212 by any suitable means, such as by friction in a snug, interference, or friction fit, by adhesive such as glue, epoxy, etc., by mechanical fasteners such as nails, screws, etc., or by any other suitable technique or device. In some implementations, the fence rail insert 208 is not secured to the fence rail 206, and can fit loosely within the cavity 212. As shown in particular in FIGS. 5 and 6, the cavity 212 can have features configured to lock the insert 208 within the cavity 212, and specifically to lock the insert 208 within the cavity 212 and prevent its movement out of the cavity 212 in the direction of the first major side surface 214 of the fence rail 206.

For example, when viewed along an axis perpendicular to the end face 216 of the fence rail 206, the cavity 212 has a cross-sectional shape that generally resembles a truncated form of the Greek letter Omega, that is, Ω. A distal end of the cavity 212 farthest from the first major side surface 214 of the fence rail 206 includes a groove 218 (see FIGS. 5 and 6), having a first width W1, that extends around a perimeter of the distal end of the cavity 212. A portion of the cavity 212 adjacent the groove 218, and proximal to the first major side surface 214 with respect to the groove 218, includes a neck portion 220 having a second width W2 that is smaller than the first width W1. A portion of the cavity 212 adjacent the neck portion 220, and extending to the first major side surface 214 of the fence rail 206, includes a head portion 222 that has a gradually increasing width moving from the neck portion 220 toward the first major side surface 214. When viewed along an axis perpendicular to the first major side surface 214 of the fence rail 206, the cavity 212 has a cross-sectional shape including a rectangle having sides that are square (i.e., perpendicular or parallel) to the end face 216 of the fence rail 206 and extending into the fence rail 206 from the end face 216 of the fence rail 206, and a semi-circle or semi-oval extending further into the fence rail 206 from an end of the rectangle. This may also be characterized as a "D" shape.

Figure 7:
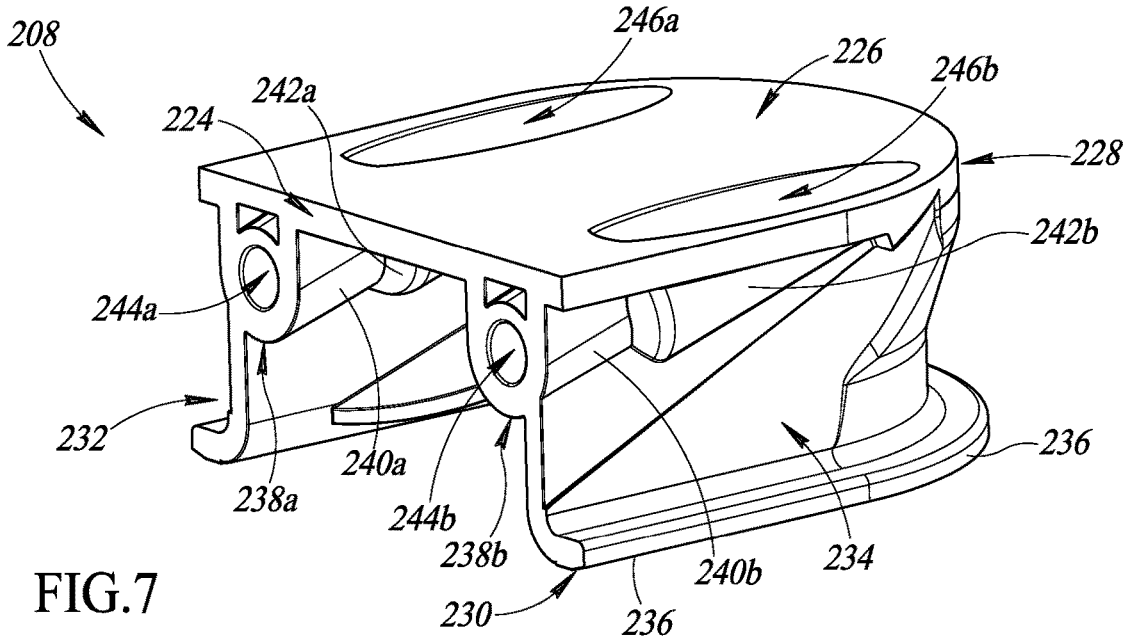
FIG. 7 shows the fence rail insert of FIG. 2 without the other components shown in FIG. 2.
Figure 8:
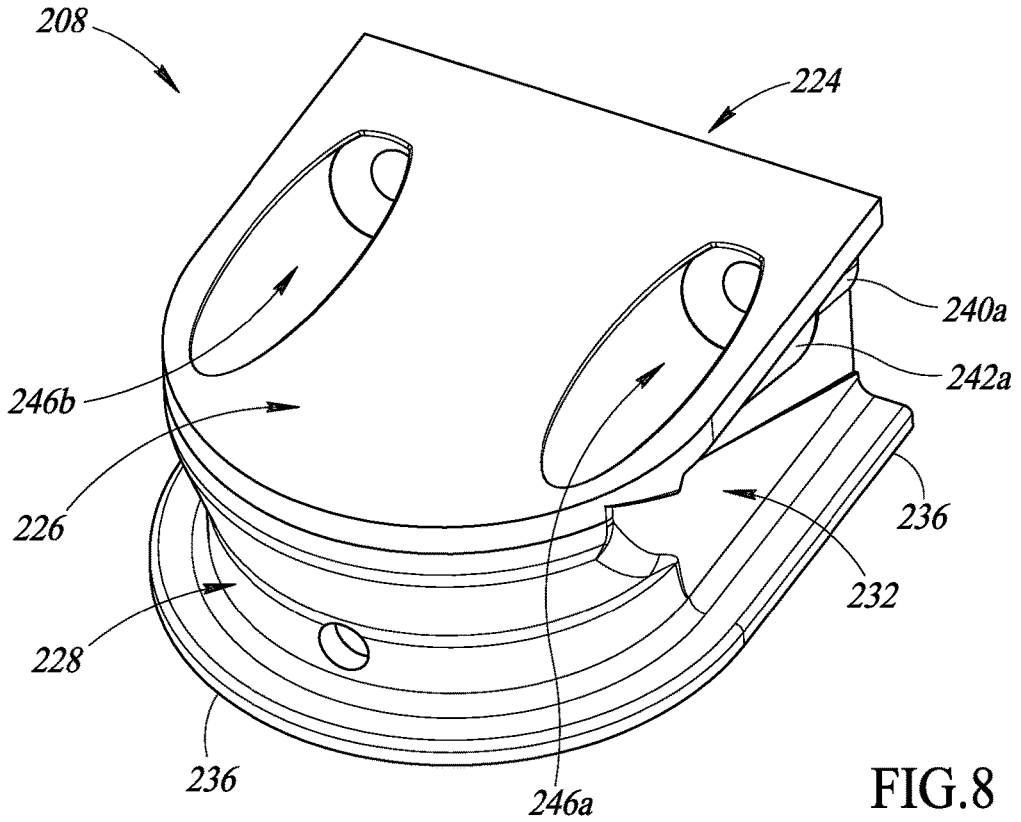
FIG. 8 shows the fence rail insert of FIG. 2 from another angle.
Figure 9:
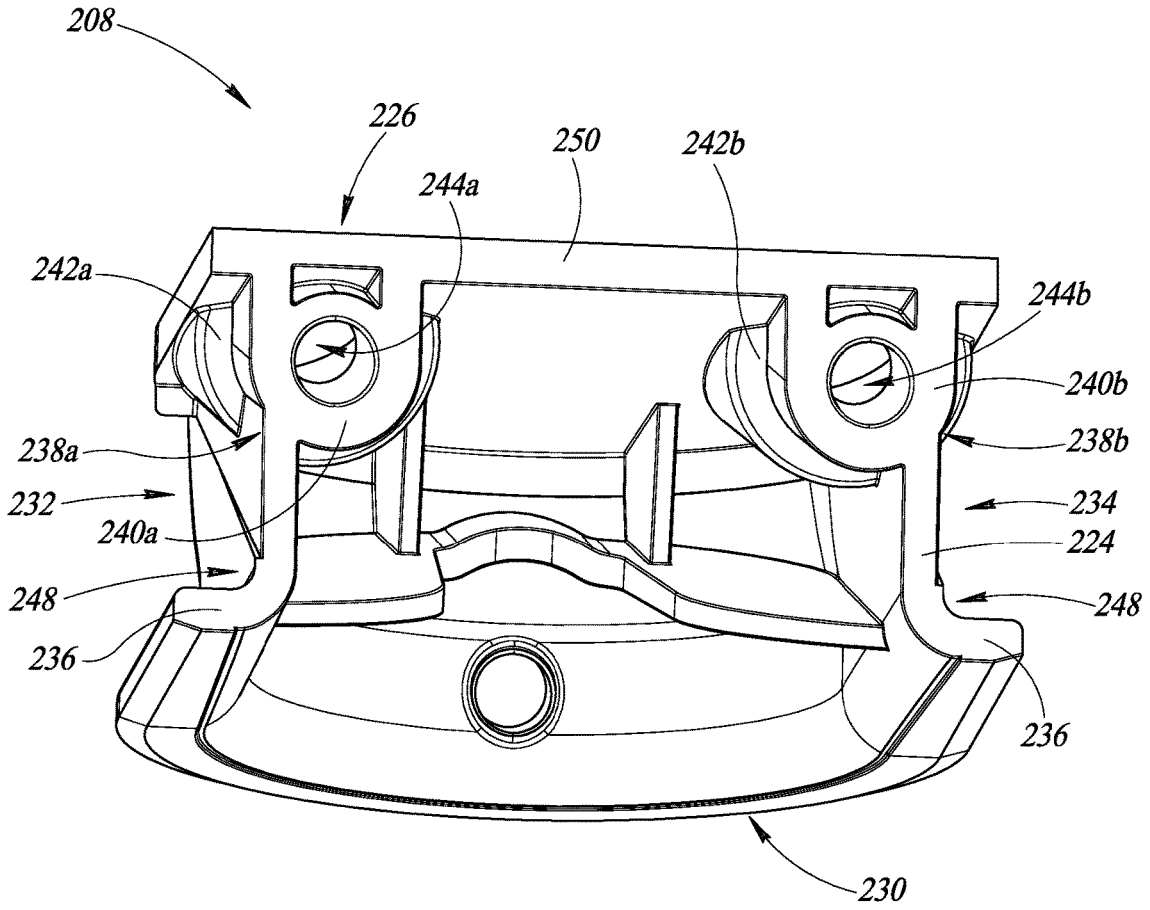
FIG. 9 shows the fence rail insert of FIG. 2 from another angle.

FIGS. 7 through 9 illustrate the fence rail insert 208 without the rest of the components of the assembly 200, to more clearly illustrate the fence rail insert 208. In particular, FIG. 7 illustrates the fence rail insert 208 from a top, right-side, and front view, FIG. 8 illustrates the fence rail insert 208 from a top, left-side, and rear view, and FIG. 9 illustrates the fence rail insert 208 from a bottom, left-side, and front view. As shown in FIGS. 7 through 9, the fence rail insert 208 has a front end 224, a rear end 228 opposite the front end 224, a top end 226, a bottom end 230 opposite the top end 226, a left side 232, and a right side 234 opposite the left side 232, such that the left and right sides 232, 234 are positioned in the conventional sense with respect to the front and rear ends 224, 228. References to top, bottom, front, rear, and left and right sides of the fence rail insert 208 are independent of the vertical and horizontal axes described above with respect to the assembly 200 and are for convenience only—a "top end" of the fence rail insert 208 is not necessarily above its "bottom end" when installed in the field. The front end 224 is aligned generally perpendicular to the top and bottom ends 226, 230 and to the left and right sides 232, 234. The fence rail insert 208 includes a ridge 236 that protrudes and extends radially outward from the left side 232, the rear end 228, and the right side 234 of the fence rail insert 208 adjacent its bottom end 230. The ridge 236 is sized and shaped to fit within the groove 218 of the cavity 212, either snugly or loosely.

FIGS. 7 through 9 also illustrate that the fence rail insert 208 includes a first fastener guide, which can be a first screw guide 238*a* positioned at the left side of the fence rail insert 208, and a second fastener guide, which can be a second screw guide 238*b* positioned at the right side of the fence rail insert 208, which are collectively referred to herein as screw guides 238. The screw guides 238 include respective first hollow cylinders 240*a*, 240*b*, referred to collectively herein as first hollow cylinders 240, and respective second hollow cylinders 242*a*, 242*b*, referred to collectively herein as second hollow cylinders 242. The first and second hollow cylinders 240*a*, 242*a* are provided end-to-end and co-axially such that they form a continuous hollow passage extending from a first opening 244*a* of the first hollow cylinder 240*a* in the front end 224 of the fence rail insert 208, to a second opening 246*a* of the second hollow cylinder 242*a* in the top end 226 of the fence rail insert 208. Similarly, the first and second hollow cylinders 240*b*, 242*b* are provided end-to-end and co-axially such that they form a continuous hollow passage extending from a first opening 244*b* of the first hollow cylinder 240*b* in the front end 224 of the fence rail insert 208, to a second opening 246*b* of the second hollow cylinder 242*b* in the top end 226 of the fence rail insert 208.

The first hollow cylinders 240*a*, 240*b* have first inside diameters that are sized to receive the body of a fastener such as a nail or a screw therethrough, and the second hollow cylinders 242*a*, 242*b* have second inside diameters that are larger than the first inside diameters and sized to receive the head of a nail or a screw therein. The first and second screw guides 238*a*, 238*b* extend parallel to one another and extend parallel to the planes of the left and right sides 232, 234. The screw guides 238 extend, however, at oblique angles to the front end 224 and to the top end 226 of the fence rail insert 208. For example, the screw guides 238 can extend at a 15° angle, or at a 15° angle±2°, or at a 15° angle±5° with respect to the top end 226 of the fence rail guide, and at a 75° angle, or at a 75° angle±2°, or at a 75° angle±5° with respect to the front end 224 of the fence rail insert 208.

As discussed above, when viewed along an axis perpendicular to its front end 224 (i.e., when viewed from the front), the fence rail insert 208 has a cross-sectional shape that at least partially resembles a truncated form of the Greek letter Omega, that is, Ω. The peripheral ridge 236 extends radially outwardly from the fence rail insert 208 at its bottom end 230, and can have a width matching or corresponding to the width W1 of the groove 218 so that the ridge 236 can fit either snugly or loosely within the groove 218. The fence rail insert 208 can also include a neck portion 248 (see FIG. 9) just above the ridge 236, which can have a width less that the width W2 of the neck portion 220 of the cavity 212, so that the neck portion 248 of the fence rail insert 208 can fit loosely within the neck portion 220 of the cavity 212. The fence rail insert 208 can also include a top plate 250 (see FIG. 9) just above the neck portion 248 and at the top end 226 of the fence rail insert 208, which can have dimensions matching the opening formed in the first major side surface 214 of the fence rail 206 so that the top plate 250 can be snugly received within that opening to present a complete and flush surface at the side of the fence rail 206.

As discussed above, when viewed along an axis perpendicular to the top end 226 of the fence rail insert 208 (i.e., when viewed from above), the fence rail insert 208 has a cross-sectional shape including a rectangle and a semi-circle or semi-oval extending outward from one of the sides of the rectangle, or "D" shape. This shape of the fence rail insert 208 can correspond to or match the corresponding shape of the cavity 212 when viewed along an axis perpendicular to the first major side surface 214 of the fence rail 206. Given the correspondence between the dimensions of the cavity 212 and the fence rail insert 208, as described above, the fence rail insert 208 can slide into the cavity 212 through the end face 216 of the fence rail 206 such that the ridge 236 of the fence rail insert 208 is seated within the groove 218 of the cavity 212 and behind the neck portion 220 of the cavity 212. In such an arrangement, the fence rail insert 208 can slide longitudinally through the cavity 212 with respect to the fence rail 206, but is prevented from moving in any directions transverse to the length of the cavity 212 of the fence rail 206 so that, for example, the fence rail insert 208 cannot pass out of the cavity through the opening in the first major side surface 214 of the fence rail 206.

Figure 10:
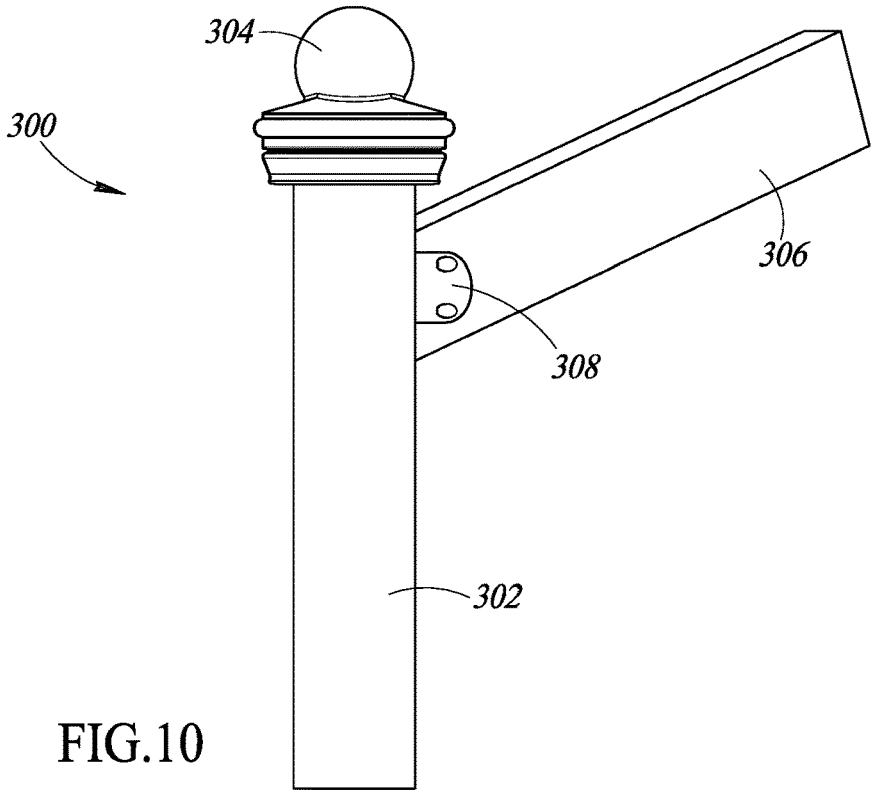
FIG. 10 shows a front elevational view of another fence rail insert being used to couple a fence rail to a fence post.
Figure 11:
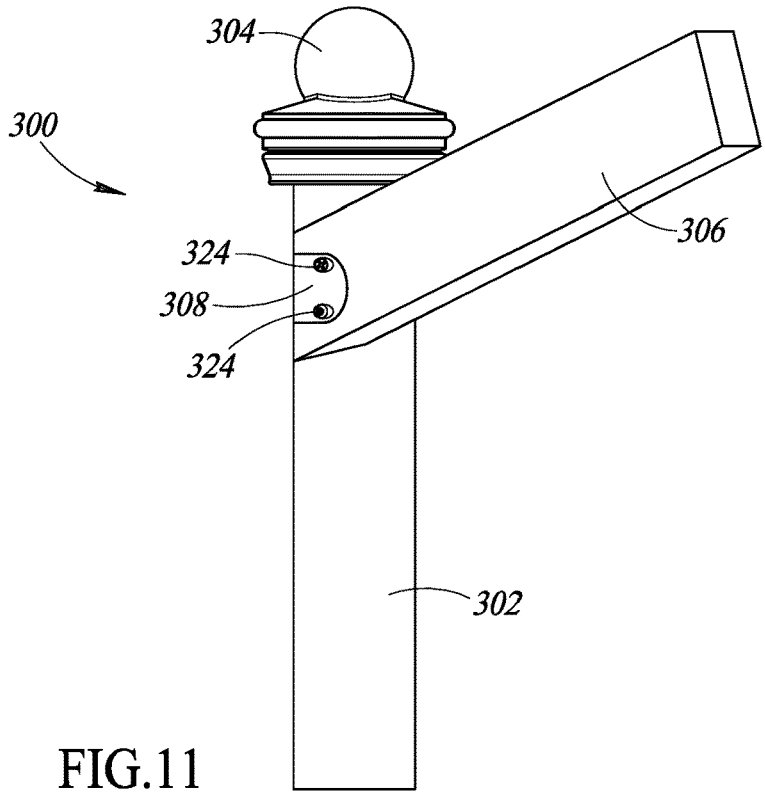
FIG. 11 shows a right side elevational view of the fence rail insert of FIG. 10 being used to couple the fence rail of FIG. 10 to the fence post of FIG. 10.

FIG. 10 illustrates a front view of an assembly 300 of components of a fence coupled to one another, including a fence post 302, a fence post cap 304, a fence rail 306, and a fence rail bracket or fence rail insert 308. FIG. 11 illustrates a right-side view of the assembly 300. Except as otherwise described herein, the assembly 300 and components thereof can have features similar or identical to those of the assembly 200 and respective components thereof. As shown in FIGS. 10 and 11, the fence rail 306 is coupled to the fence post 302, which is vertical, so that the fence rail 306 is oriented upwardly relative to horizontal as it extends away from the fence post 302, and so that the fence rail 306 extends both rearwards and to the right as it extends away from the fence post 302.

Figure 12:
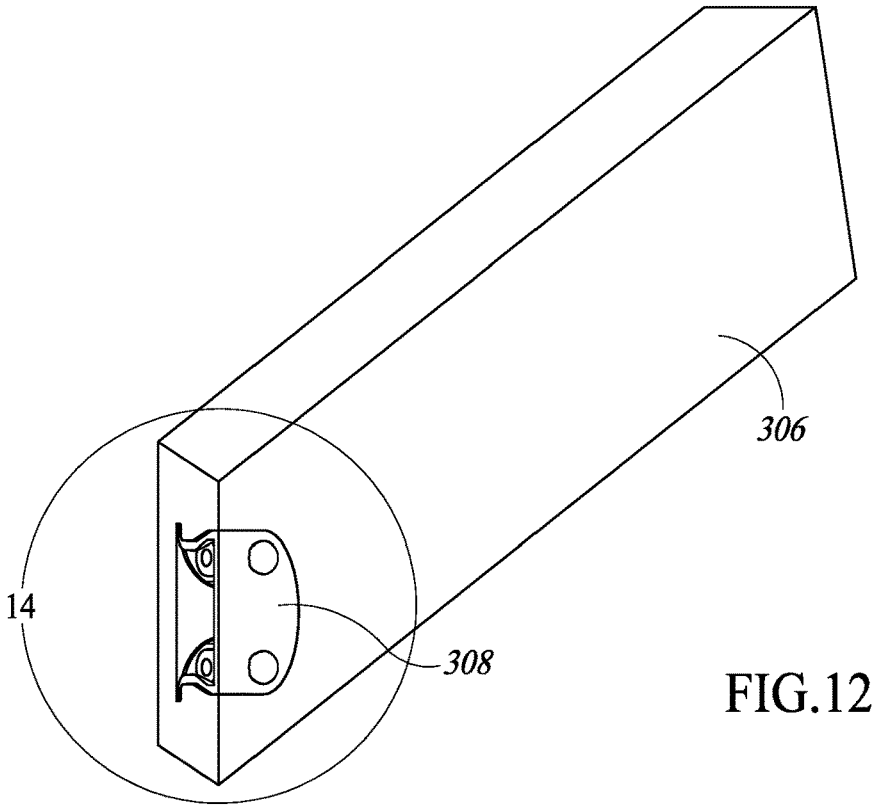
FIG. 12 shows the fence rail insert and fence rail of FIG. 10 without the fence post of FIG. 10.
Figure 13:
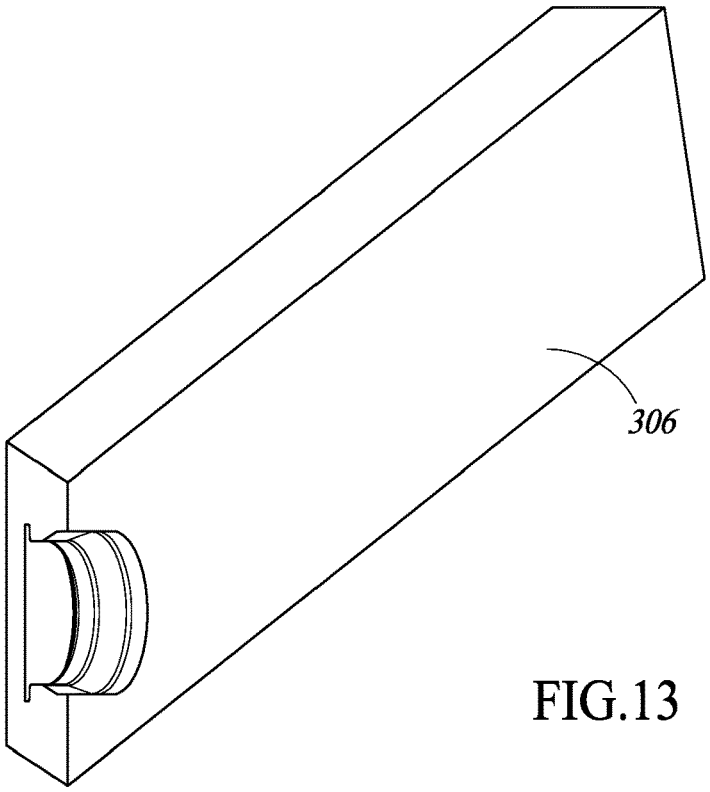
FIG. 13 shows the fence rail of FIG. 10 without the fence rail insert or the fence post of FIG. 10.
Figure 14:
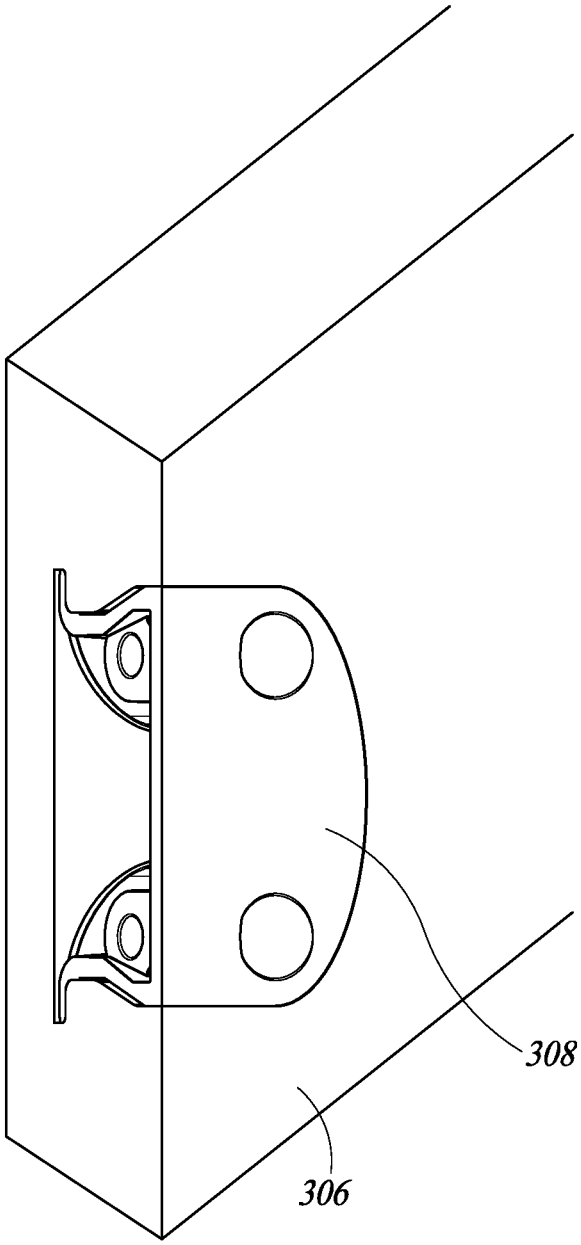
FIG. 14 shows an enlarged detail view of the fence rail insert and the fence rail taken from FIG. 12.

FIG. 12 illustrates the fence rail 306 and the fence rail insert 308 without the rest of the components of the assembly 300 and from another angle, to more clearly illustrate these components. FIG. 13 illustrates the fence rail 306 without the rest of the components of the assembly 300 from the same angle as in FIG. 12, to more clearly illustrate the fence rail 306. FIG. 14 illustrates an enlarged portion of FIG. 12 to more clearly illustrate the fence rail 306 and the fence rail insert 308.

Figure 15:
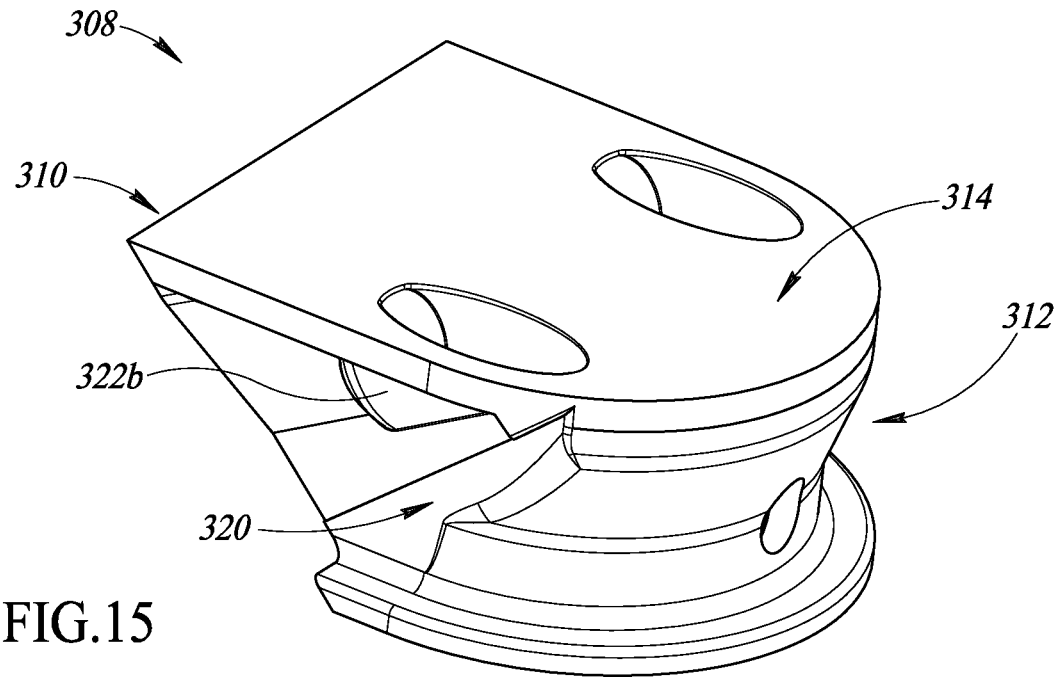
FIG. 15 shows the fence rail insert of FIG. 10 without the other components shown in FIG. 10.
Figure 16:
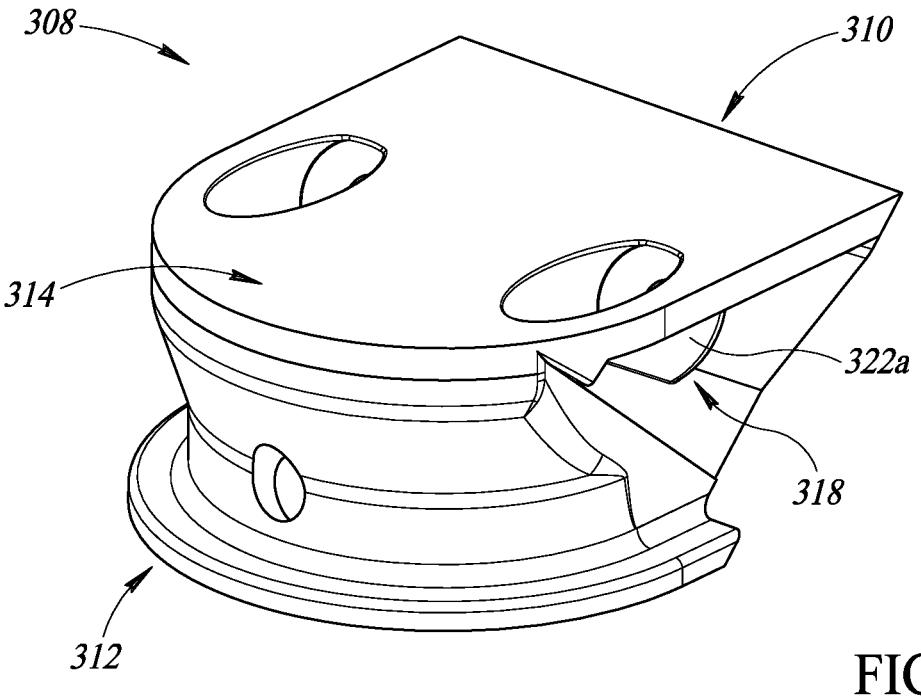
FIG. 16 shows the fence rail insert of FIG. 10 from another angle.
Figure 17:
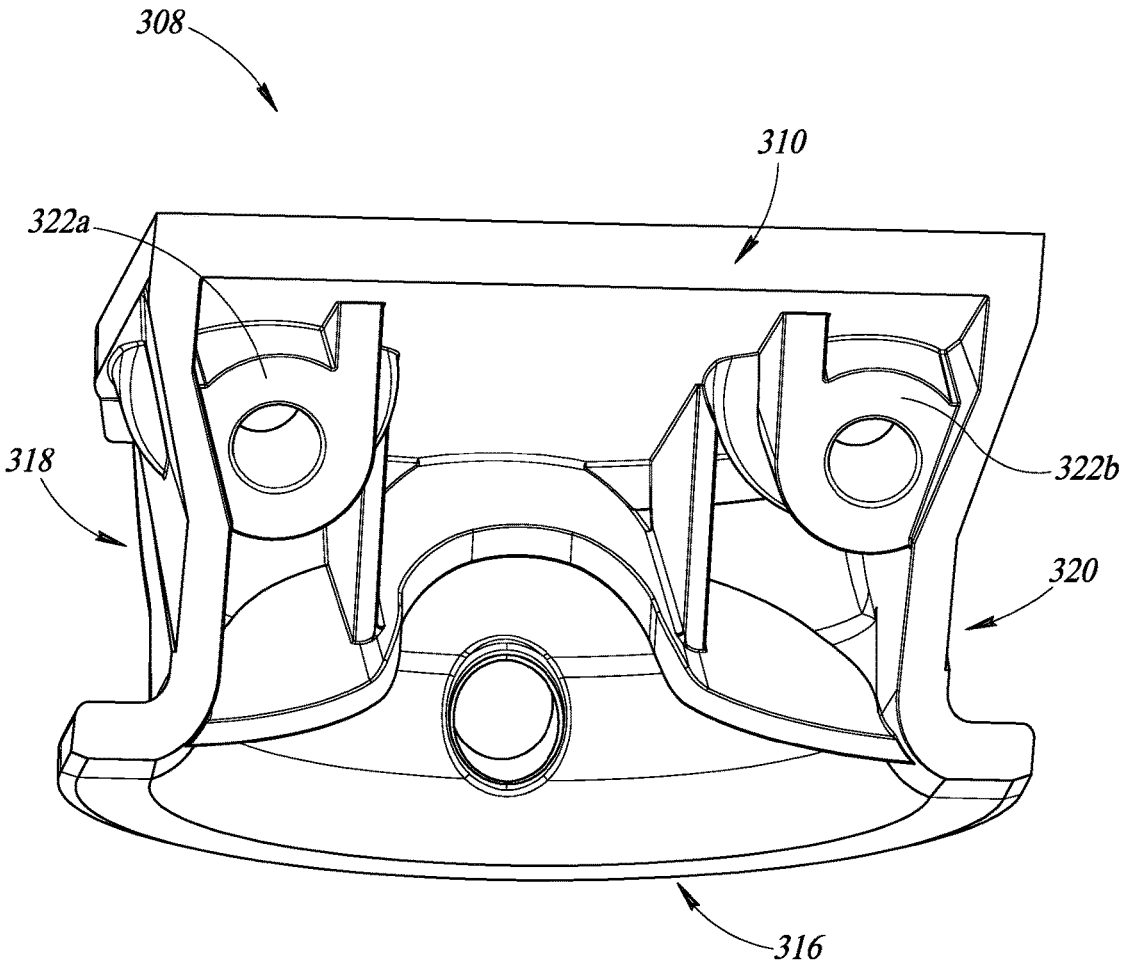
FIG. 17 shows the fence rail insert of FIG. 10 from another angle.

FIGS. 15 through 17 illustrate the fence rail insert 308 without the rest of the components of the assembly 300, to more clearly illustrate the fence rail insert 308. In particular, FIG. 15 illustrates the fence rail insert 308 from a top, right-side, and rear view, FIG. 16 illustrates the fence rail insert 308 from a top, left-side, and rear view, and FIG. 17 illustrates the fence rail insert 308 from a bottom, center, and front view. As shown in FIGS. 15 through 17, the fence rail insert 308 has a front end 310, a rear end 312 opposite the front end 310, a top end 314, a bottom end 316 opposite the top end 314, a left side 318, and a right side 320 opposite the left side 318, such that the left and right sides 318, 320 are positioned in the conventional sense with respect to the front and rear ends 310, 312.

FIGS. 15 through 17 also illustrate that the fence rail insert 308 includes a first screw guide 322*a* positioned at the left side of the fence rail insert 308 and a second screw guide 322*b* positioned at the right side of the fence rail insert 308, which are collectively referred to herein as screw guides 322. The screw guides 322 extend at oblique angles to the front end 310 and to the top end 314 of the fence rail insert 308. For example, the screw guides 322 can extend at a 30° angle, or at a 30° angle±2°, or at a 30° angle±5° with respect to the top end 314 of the fence rail guide, and at a 60° angle, or at a 60° angle±2°, or at a 60° angle±5° with respect to the front end 310 of the fence rail insert 308.

Further, FIGS. 15 through 17 also illustrate that the front end 310 includes a front surface that, like the front end 224 of the fence rail insert 208, extends generally perpendicular to its left and right sides 318, 320, but unlike the front end 224 of the fence rail insert 208, extends at an oblique angle to its top and bottom ends 314, 316. For example, the front surface of the front end 310 can extend at a 45° angle, or at a 45° angle±5°, or at a 45° angle±10° with respect to the top and bottom ends 314, 316. As a result of this oblique angle, the front surface of the fence rail insert 208 forms an acute angle with the top end 314 of the fence rail bracket 308 and an obtuse angle with the bottom end 316 of the fence rail bracket 308, and the top end 314 of the fence rail bracket 308 is larger than the bottom end 316 of the fence rail bracket 308.

Together, the fence rail brackets 208, 308 can be used to couple a fence rail to a fence post at a wide variety of angles with an end face of the fence rail flush with a side surface of the fence post. In particular, either of the fence rail brackets 208, 308 can be used to couple a fence rail to a fence post at a wide variety of angles above or below horizontal. Further, if a fence rail is to be coupled to a right-side surface of a fence post with a fence rail bracket installed within a front-facing major surface of the fence rail, then the fence rail insert 208 can be used to couple the fence rail to the fence post at a wide variety of angles about a vertical axis with respect to the right-side surface of the fence post, ranging from 45° or less than 45° to 90° or greater than 90°, where 0° with respect to the surface faces forward, as illustrated in FIGS. 2 and 3. Similarly, if a fence rail is to be coupled to a right-side surface of a fence post with a fence rail bracket installed within a front-facing major surface of the fence rail, then the fence rail bracket 308 can be used to couple the fence rail to the fence post at a wide variety of angles about a vertical axis with respect to the right-side surface of the fence post, ranging from 90° or less than 90° to 135° or greater than 135°, where 180° with respect to the surface faces rearward, as illustrated in FIGS. 10 and 11.

Figure 18:
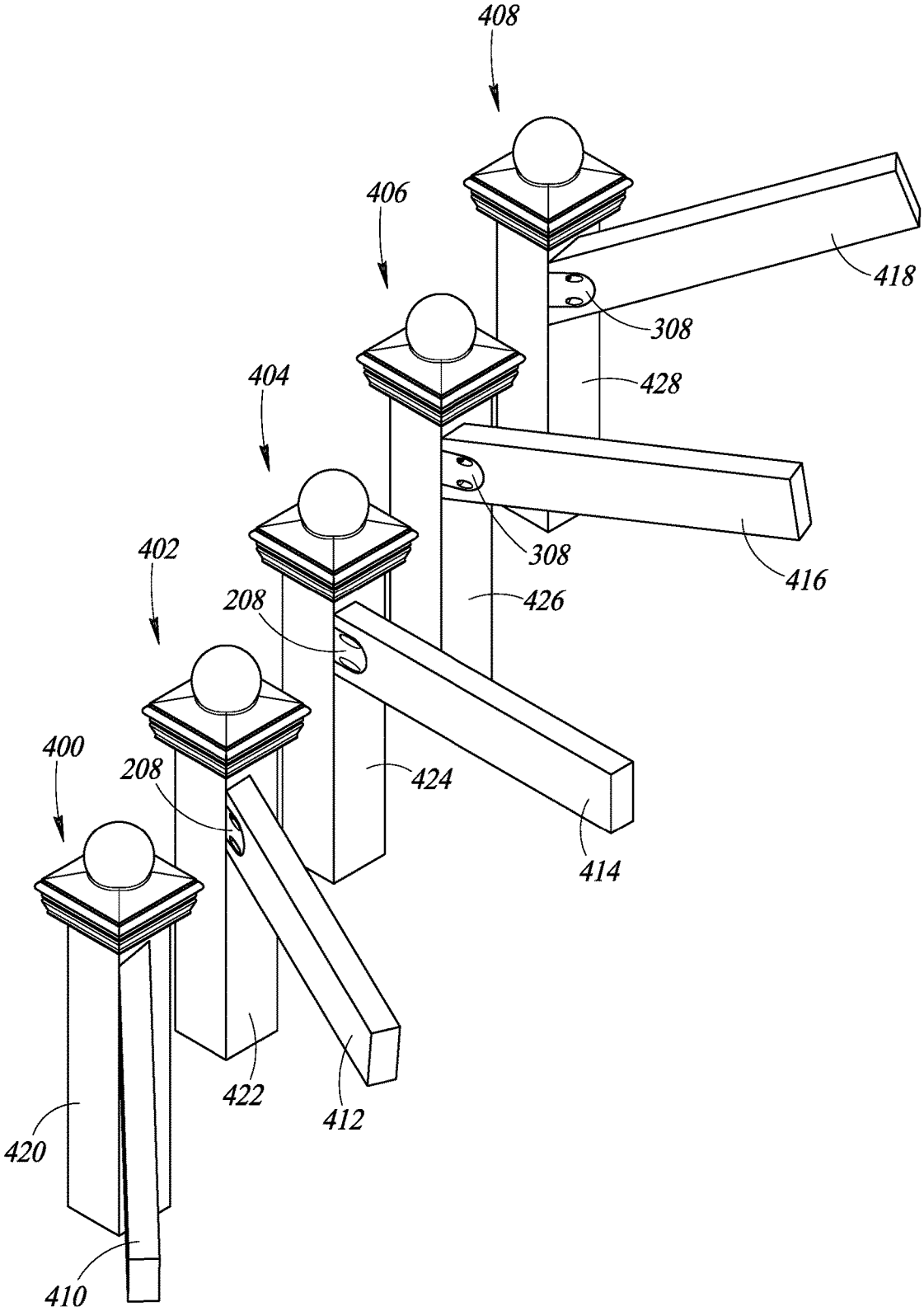
FIG. 18 shows a plurality of fence rail inserts being used to couple respective fence rails to respective fence posts.
Figure 19:
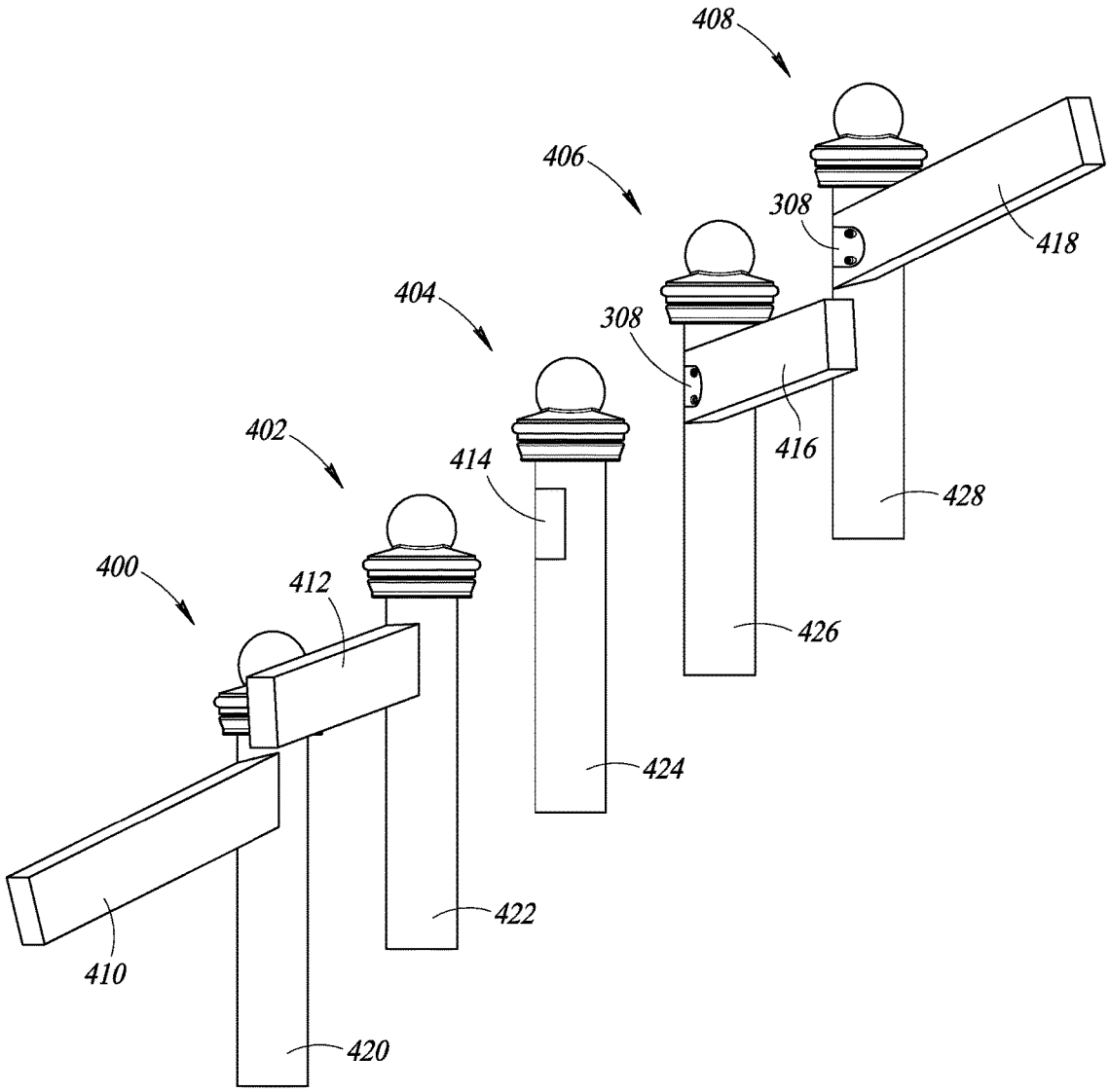
FIG. 19 shows the fence rail inserts, fence rails, and fence posts of FIG. 18 from another angle.

Thus, FIGS. 18 and 19 illustrate that the fence rail inserts 208, 308 can be used to couple fence rails to fence posts at a wide variety of angles. For example, FIGS. 18 and 19 show that a first assembly 400 can include a fence rail insert 208 used to couple a fence rail 410 to a right-side surface of a fence post 420 such that the fence rail 410 extends downward and forward at approximately a 45° angle with respect to the right-side surface of the fence post 420. As another example, a second assembly 402 can include a fence rail insert 208 used to couple a fence rail 412 to a right-side surface of a fence post 422 such that the fence rail 412 extends downward, but less so than the fence rail 410, and forward at approximately a 67.5° angle with respect to the right-side surface of the fence post 422.

As another example, a third assembly 404 can include a fence rail insert 208 used to couple a fence rail 414 to a right-side surface of a fence post 424 such that the fence rail 414 extends horizontally and straight outward at approximately a 90° angle with respect to the right-side surface of the fence post 424. As another example, a fourth assembly 406 can include a fence rail insert 308 used to couple a fence rail 416 to a right-side surface of a fence post 426 such that the fence rail 416 extends upward and rearward at approximately a 112.5° angle with respect to the right-side surface of the fence post 426. As another example, a fifth assembly 408 can include a fence rail insert 308 used to couple a fence rail 418 to a right-side surface of a fence post 428 such that the fence rail 418 extends upward, to a greater degree than the fence rail 416, and rearward at approximately a 135° angle with respect to the right-side surface of the fence post 428.

It can be advantageous to use the fence rail insert 208 rather than the fence rail insert 308 in the assemblies 400, 402, 404, at least because the angle of the screw guides 238 with respect to the front end 224 of the fence rail insert 208 is closer to 90° than the corresponding angle of the screw guides 322, and as a result, screws (e.g., screws 252 shown in FIG. 2) extending through the screw guides 238 are better able to reach and bite into the side surface of the respective fence posts in the assemblies 400, 402, 404. Further, it can be advantageous to use the fence rail insert 308 rather than the fence rail insert 208 in the assemblies 406, 408, at least because the front surface of the fence rail insert 308 extends at an oblique angle to the top and bottom ends of the fence rail insert 308, and as a result, screws (e.g., screws 324 shown in FIG. 11) extending through the screw guides 322 are better able to reach and bite into the side surface of the respective fence posts in the assemblies 406, 408.

The fence rail inserts 208, 308 are described above as being used to couple a fence rail to a right side surface of a fence post, with the fence rail insert 208 or 308 being installed within a cavity in a front-facing major surface of the fence rail. In alternative embodiments, however, the fence rail inserts 208, 308 can be used to couple a fence rail to a right side surface of a fence post, with the fence rail insert 208 or 308 being installed within a rear-facing major surface of the fence rail. In such embodiments, the angles at which the fence rail inserts 208, 308 are able to couple a fence rail to a side surface of a fence post are reversed, such that, for example, the fence rail insert 208 could be used in assemblies 404, 406, 408, and the fence rail insert 308 could be used in assemblies 400, 402.

Moreover, although the inserts 208, 308 are able to facilitate mounting of rails at a wide variety of angles relative to the posts, it is appreciated that additional inserts may be provided in different configurations to provide mounting at each of a variety of different angles. For example, inserts having end faces that vary from one another in five degree increments may be provided for mounting at respective incremental angles.

In view of the embodiments described above, it is appreciated that various related methods may be provided. For example, a method of assembling a fence using the fence rail inserts 208, 308 can include collecting information regarding the site where the fence is to be assembled and installed. Based on this information, a fence layout including locations and dimensions of fence posts and fence panels can be designed, and the materials can be cut to size. In cutting the materials to size, the fence rails can be cut to include cavities to receive the fence rail inserts 208 or 308 at both ends of each fence rail, and to include end faces angled with respect to the length of the fence rails so they will sit flush or generally flush against adjacent fence posts when installed. The precise dimensions of the cavities and orientations of the end faces at either end of the fence rails can be determined based on the designed fence layout.

Various components of the fence can then be coupled to one another to form a plurality of pre-manufactured fence panels or rail assemblies, which are then shipped to the installation site, or the various components of the fence can be shipped to the installation site for on-site assembly. At an installation site, a first fence post can be installed to stand vertically from the ground. A first pair of fence rail inserts can be inserted into respective cavities at first ends of respective fence rails, and the fence rails can then be coupled to the first fence post by positioning the first end faces of the fence rails adjacent to or abutting the first end faces of the fence rails against a side surface of the fence post, and fastening a fastener (e.g., screwing screws or nailing nails) through the fastener guides of the first pair of fence rail inserts and into the side surface of the fence post.

A second pair of fence rail inserts can then be inserted into respective cavities at second ends of the fence rails opposite to their first ends, and a second fence post can be installed to stand vertically from the ground so that a side surface of the second fence post is flush with the second ends of the fence rails. Fasteners can then be positioned to extend through the fastener guides of the second pair of fence rail inserts and into the side surface of the fence post to couple the fence rails to the second fence post. At this stage, the fence rails are effectively sandwiched between the first and second fence posts, and as long as the fence posts remain stationary, the fence rail inserts at both ends of the fence rails are effectively locked into their respective fence rail cavities. Thus, the fence rail inserts can be used to secure the fence rails to the fence posts even if they fit only loosely within their respective cavities at the ends of the fence rails.

Portions of the method described above can be repeated to install additional fence posts and additional fence panels, as needed to complete a functional fence. In some implementations, the cavities at either end of a fence rail can be located in the same major side surface of the fence rail as one another. In other implementations, the cavities at either end of a fence rail can be located in opposite major side surfaces to one another. In some implementations, the cavities at the ends of each of the fence rails can be located on a specific major side surface of the fence rail so that the cavities are hidden when the fence is assembled and installed. For example, the cavities can be formed in the major side surface of the fence rails to which the fence boards of the fence are to be coupled, so that the fence boards, when installed, cover and hide the fence rail inserts, thereby improving the aesthetics of the completed fence.

Methods of assembling a fence can include a manufacturer building a plurality of pre-manufactured fence panels or rail assemblies, as described above. The pre-manufactured fence panels or rail assemblies can each include one or more rails, the rails each including respective rail cavities and rail inserts, as described above. The manufacturer can then ship the fence panels or rail assemblies, with or without a plurality of posts, to an end-user such as a home or business owner, or to a professional installer working on the end-user's behalf. For example, the manufacturer can ship the components to an installation site such as the home or place of business of the end-user. At the installation site, the end-user or professional installer can assemble and install the fence from the constituent components, as described above.

Although the embodiments illustrated in the figures are directed in particular to constructing fences or fence components, it is appreciated that aspects described herein may be well-suited for constructing other structures including rails, such as, for example, handrails.

In addition, although the embodiments illustrated in the figures show fence rails coupling directly to vertical fence posts using rail inserts, it is appreciated that fence rails may be coupled to other vertical fence members, such as an intermediate fence component, which may then be subsequently fastened to vertical fence posts, as may be the case when providing pre-fabricated fence panels with vertical end members for installation between opposing fence posts.

Moreover, aspects and features of the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A structure, comprising:

a vertical fence member having a side surface;

a rail extending outwardly from the side surface of the vertical fence member, the rail including an insert cavity at an end of the rail adjacent to the vertical fence member, the cavity including a blind hole formed in a first major side surface of the rail and a groove formed around a periphery of the blind hole, wherein the rail includes an end face that is flush with the side surface of the vertical fence member;

a rail insert positioned within the insert cavity, the rail insert including a ridge engaged with the groove to prevent movement of the rail insert toward the first major side surface of the rail, and the rail insert including a fastener guide; and a fastener extending through the fastener guide of the rail insert and into the side surface of the vertical fence member.

2. The structure of claim 1, wherein the rail extends outwardly from the side surface of the vertical fence member at an oblique angle.

3. The structure of claim 1 wherein the rail extends outwardly from the side surface of the vertical fence member at an oblique angle relative to a vertical reference plane perpendicular to the side surface of the vertical fence member.

4. The structure of claim 1 wherein the rail extends outwardly from the side surface of the vertical fence member at an oblique angle relative to a horizontal reference plane.

5. The structure of claim 1 wherein the groove is formed around a periphery of a bottom end of the blind hole.

6. The structure of claim 1 wherein the insert cavity is formed in the end of the rail such that the rail insert is slidably engageable with the rail in a direction aligned with a longitudinal length of the rail.

7. An assembly, comprising:

a vertical fence member having a side surface;

an elongated rail having a respective insert cavity formed in each of opposing ends thereof, each insert cavity including a respective blind hole formed in a major side surface of the rail and a respective groove formed around a periphery of the respective blind hole, wherein the elongated rail includes an end face that is flush with the side surface of the vertical fence member; and a respective rail insert insertably received in each insert cavity, each rail insert comprising a ridge engaged with the respective groove to prevent movement of the rail insert toward the major side surface of the rail, and each rail insert comprising a fastener guide to receive a fastener through the rail insert to secure the respective end of the rail to the vertical fence member.

8. The rail assembly of claim 7 wherein each rail insert is accommodated within the confines of an outer profile of the elongated rail.

* * * * *